United States Patent [19]

Ferrell

[11] 4,241,865

[45] Dec. 30, 1980

[54] RECLOSABLE SHIPPING SACK AND METHOD

[75] Inventor: Robert A. Ferrell, Shelbyville, Ind.

[73] Assignee: KCL Corporation, Shelbyville, Ind.

[21] Appl. No.: 64,044

[22] Filed: Aug. 6, 1979

[51] Int. Cl.[3] ..... B65D 33/26

[52] U.S. Cl. ..... 229/62; 150/3; 156/66; 156/93; 206/618

[58] Field of Search ..... 150/3; 229/62; 206/610, 206/618, 632; 156/66, 93

[56] References Cited

U.S. PATENT DOCUMENTS

| | | | |
|---|---|---|---|
| 1,920,321 | 8/1933 | Rosmait | 229/62 |
| 1,930,659 | 10/1933 | Purdy | 150/3 |
| 1,951,599 | 3/1934 | Dever | 150/3 |
| 2,978,769 | 4/1961 | Harrah . | |
| 3,030,003 | 4/1962 | Schanzle | 206/618 X |
| 3,619,395 | 11/1971 | Shendzic . | |
| 3,685,562 | 8/1972 | Ausnit . | |

*Primary Examiner*—Donald F. Norton

*Attorney, Agent, or Firm*—Hill, Van Santen, Steadman, Chiara & Simpson

[57] ABSTRACT

A reclosable sack having a pouring mouth from which discrete pourable contents may be discharged, comprises a primary non-reclosable stitched closure fastener across and closing the mouth against unintentional discharge of the contents and includes means such as chain stitch and rip strip for facilitating digital opening of the primary closure fastener. A secondary, reclosable fastener, desirably of the zipper type, extends across the sack mouth outwardly from the primary closure fastener and is adapted for selectively opening and closing the sack mouth after opening of the primary closure fastener. A method of making the reclosable sack is also disclosed.

22 Claims, 9 Drawing Figures

RECLOSABLE SHIPPING SACK AND METHOD

This invention relates to the art of reclosable bags or sacks, and is more particularly concerned with a new and improved reclosable sack having a primary non-reclosable separable closure fastener and a secondary reclosable fastener.

Various schemes have been proposed for tamperproof bags which are equipped with reclosable fasteners and also with some means to preclude access to the contents of the bag without evidence of tampering. For example, in U.S. Pat. No. 2,978,769, an arrangement is disclosed in which a bag is equipped with a pair of closure strips having interengageable groove and rib closure means, and in addition, a relatively thin web-like connection of the closure strips inwardly from the fastener profiles and which closure strip must be ruptured to gain access into the bag. Another scheme provides for enclosing the separable fastener against access until it is desired to open the bag, as for example in U.S. Pat. No. 3,619,395 which provides a tear ribbon on a top projecting portion of the bag. Another such arrangement is found in U.S. Pat. No. 3,685,562.

However, all of the tamperproof bags to which reference has just been made, are for packaging relatively small quantities of goods, such as nails, screws, nuts, bolts, food products and the like, rarely exceeding more than a few ounces or a few pounds, so that plastic tear webs or weakened web areas will safely hold against normal handling in packaging, shipping and shelf stacking or other merchandise display. Such tamperproof closures are, however, not satisfactory for heavier, bulky goods, such as dog food, charcoal, cat litter, and the like, which ordinarily require packaging which will withstand in excess of 15 pounds contents weight. In consequence, for this type of goods, the bags have heretofore had only a primary closure of some sort, which upon being opened had no means for reclosing, even though the contents may necessarily have to be poured from the bag or sack by increments with often substantial intervals between demands for more of the sack contents. In typical instances, access to the contents may extend from 10 to 50 times with intervening intervals where the opened packages are liable to be upset and contents spilled and wasted. In addition, contents often are liable to attract vermin or dry out, as a result of remaining open.

A primary aim of the present invention is to overcome the disadvantages, drawbacks, inefficiencies, shortcomings and problems inherent in the prior art having to do with packaging bulky and often heavy materials in sacks, and particularly materials which are intended to be used in general by increments over an extended period of time.

An important object of the invention is to provide a new and improved reclosable sack efficiently equipped with primary non-reclosable closure, and also a secondary, reclosable fastener.

Another object of the invention is to provide new and improved means for making a reclosable sack of the type indicated.

The invention provides a reclosable sack having a pouring mouth from which discrete pourable contents may be discharged, comprising a primary non-reclosable stitched separable closure fastener across and closing said mouth against unintentional discharge of the contents and including means for facilitating digital opening of the primary closure fastener, and a secondary, reclosable fastener across said mouth outwardly from said primary closure fastener and adapted for selectively opening and closing said mouth after opening of said primary closure fastener.

The invention also provides a method of making a reclosable sack having a pouring mouth from which discrete pourable contents may be discharged, comprising stitching a primary non-reclosable separable closure fastener across, and thereby closing, said mouth against unintentional discharge of the contents, and providing said primary closure fastener with means for facilitating digital opening thereof, and providing a secondary, reclosable fastener across said mouth outwardly from said primary closure fastener and thereby providing for selectively opening and closing said bag mouth after said primary closure fastener has been opened.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which.

Figure 1:
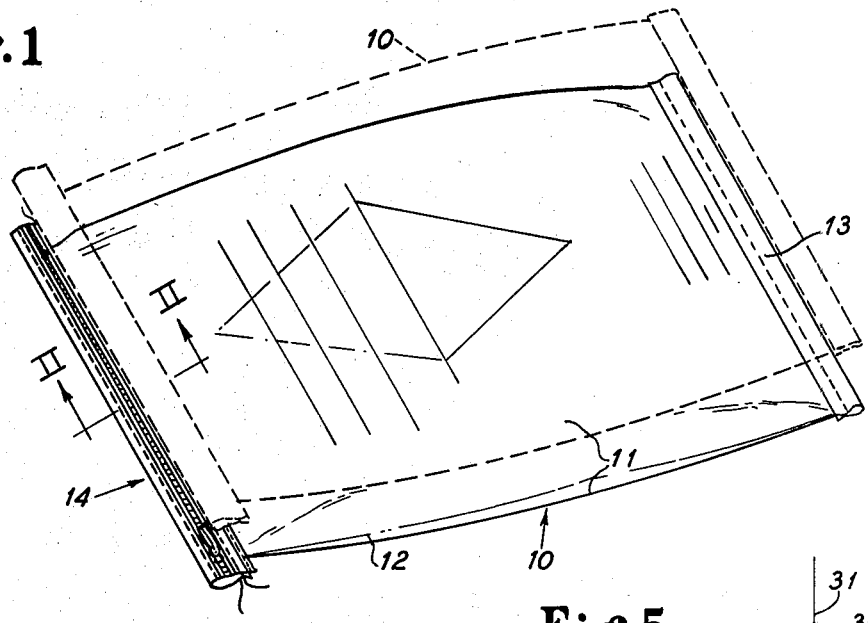
FIG. 1 is a perspective view of a reclosable sack embodying the invention.
Figure 2:
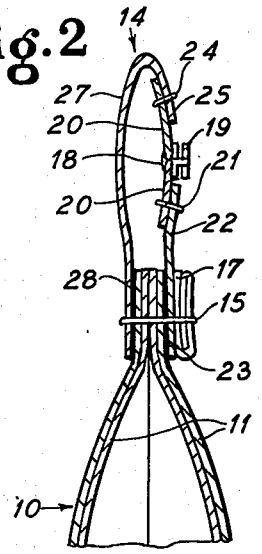
FIG. 2 is an enlarged fragmentary sectional detail view taken substantially along the line II—II of FIG. 1.

On reference to FIGS. 1 and 2, a reclosable sack 10 comprises a body which may be made of any suitable material which may be one ply or multi-ply, shown herein as multi-ply, paper, heavy duty plastic, or combinations thereof, depending upon the material to be handled, and cost considerations. In any event, the sack may be of the disposable kind, that is intended to be disposed of after the contents have been used. That is not to say that the sack must be thrown away, but that it should be capable of being produced at low cost by mass production methods. As is customary, such a sack comprises front and back face walls 11 respective opposite side edges 12; which as shown are initially simple folds but may be longitudinal gussets, to facilitate stacking the bags when flat; a fixed bottom closure 13, and a top closure 14. The bottom closure 13 may comprise any preferred structure such as the ends of the bag walls 11 turned over and adhesively secured, a folded closure strip adhesively secured or stitched in place, or the like. It will be understood that sacks of this kind are generally closed at their upper ends and the lower ends of the bags or sacks remain open until the sacks are filled through the open lower ends which are then closed to seal the contents within the container. As heretofore constructed, sacks of this type have often been equipped with tear-open top closures or with some other sort of non-reclosable but separable fastener device.

According to the present invention, the top closure 14 is constructed and arranged to provide not only a non-reclosable separable fastener, but also a reclosable fastener, so that the sack is, in effect, a tamperproof container, but when it is desired to gain access to the contents, the non-reclosable fastener is adapted to be opened, whereupon the reclosable fastener is adapted to be opened for access to the contents as by pouring from the mouth of the sack, and the reclosable fastener is then adapted to be closed to close the contents substantially against discharge of the contents, against drying out of the contents where that is a consideration, and against entrance of vermin where that is a consideration.

In a desirable construction, the top closure structure 14 comprises a primary non-reclosable stitched separable closure fastener 15 across and closing the upper end or mouth of the sack 10 against unintentional discharge of contents. The fastener 15 is also desirable for facilitating loading of the sack 10 with contents through the open bottom, which is thereafter closed by means of the bottom closure 13. In the preferred construction, the non-reclosable fastener 15 comprises a line of chain stitches securing the sack walls 11 tightly together. The chain stitching should be of the kind adapted to facilitate digital opening by pulling on one end of the stitching thread, string or cord. Preferably, a rip tape 17 is stitched on by means of the chain stitch fastener 15 on the face 11 from which the cord is adapted to be pulled when it is desired to open the fastener.

A secondary, reclosable fastener across the mouth of the sack and adapted for selectively opening and closing the sack mouth after opening of the primary closure fastener 15 comprises a zipper 18 equipped with a slider 19. The zipper 18 may be of the chain type having separable interlocking teeth or elements carried on respective zipper tapes 20. One of the zipper tapes 20 is secured as by means of lock stitching or double chain stitching 21 to an anchoring strip 22 which may be paper or any other suitable material. Instead of the stitching 21, suitable adhesive may be employed if desired. The anchor strip 22 is secured as by means of adhesive 23 to the outer face of the top of the sack wall 11 to which the rip tape 17 is attached, the rip tape being secured over the outer face of the strip 22 and the stitch fastener 15 passing through the strip 22.

Figure 3:
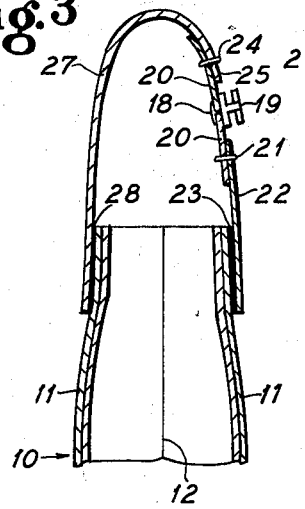
FIG. 3 is a view similar to FIG. 2, but showing the primary closure opened.

The other zipper tape 20 is secured as by means of lock stitching or chain stitching 24 to a turned or looped over flange 25 of a closure strip 27, which is secured as by means of adhesive 28 to the outer face of the top of the remaining face wall 11 of the sack, and the separable fastener stitching 15 engages the adhesively secured portion of the strip 27. Through this arrangement, when the primary separable stitched fastener 15 is removed to permit opening of the mouth of the sack 10, as shown in FIG. 3, the secondary fastener provided by the zipper 18 and the attaching strips 22 and 27 maintains a substantially closed condition of the sack top or mouth until the zipper is opened, as shown in FIG. 4, for access to the contents of the sack 10 and which contents may be poured from the sack mouth through a pouring funnel formation defined by the opened secondary fastener, as can be readily appreciated from the showing in FIG. 4.

Figure 4:
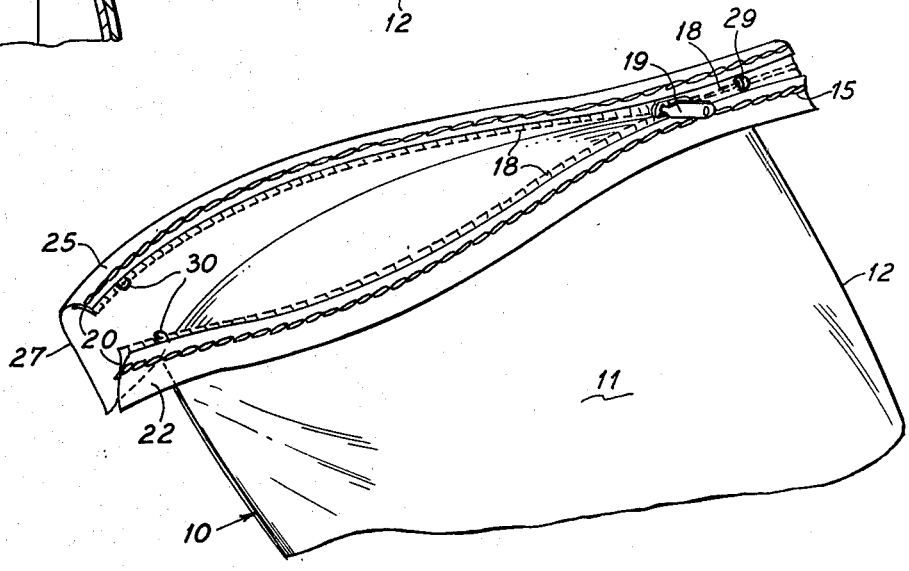
FIG. 4 is a fragmentary perspective view showing the secondary reclosable fastener opened for pouring access to the sack contents.

As best seen in FIGS. 1 and 4, the opposite ends of the top closure 14 are extended a limited distance beyond the opposite sides 12 of the sack 10 for a plurality of purposes. One such purpose is to accommodate a zipper slider terminal stop 29 at the starting terminal end of the zipper 18, and a terminal stop 30 at the closing terminal end of the zipper. These stops 29 and 30 prevent the slider 19 from escaping from either end of the closure. By their location on the extensions of the sack top closure 14, a full range of zipper opening and closing is permitted, so that when the slider is in the fully zipper open position, full access can be had into the sack 10, and when the slider 19 is stopped by the stop 30, the bag top is substantially fully closed. Although the stop 29 may be a single stop button affixed across the zipper chains, the stop 30 may comprise a pair of cooperative buttons or elements, one of each of which is affixed to each of the zipper chains as best seen in FIG. 4.

Figure 5:
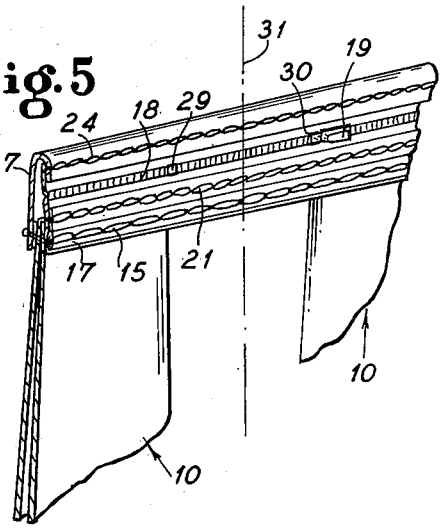
FIG. 5 is a fragmentary perspective view showing how a succession of the sacks is adapted to be equipped with the closures and then separated one from the other.

Another useful function of the sideward extensions of the closure 14 is to prevent accidental opening of the primary fastener should the rip-starting terminal end of the stitching of the primary fastener 15 become inadvertently detached. It is desirable that the stitching 15 extend at least three stitches beyond the edge of the bag. This affords a reasonable safety factor, so that if even as many as three stitches are pulled out inadvertently, the sack will still remain substantially closed. At the opposite side of the sack, the extension of the closure 14 is desirable to improve the funnel or pouring spout effect when pouring from the sack. As demonstrated in FIG. 5, attainment of the closure extensions is facilitated by having successive ones of the sacks 10 spaced apart about twice the length of the extension desired at each side and then assembling the closure device as a continuous strip across the tops of the sacks and then severing the closure strip along a line 31 intermediate the sacks. This leaves the preferred length of extension desired at one side of one of the sacks and at the other side of the contiguous sack.

A method of making the sacks 10 according to the present invention is depicted schematically in FIGS. 6–9. Initially, of course, respective sections of flattened tubular sack material to provide each of the sacks 10 are supplied from a source which may be directly from fabricating apparatus or severed from a roll of the collapsed tubular material. The techniques for producing tubular sack material are well known.

Figure 6:
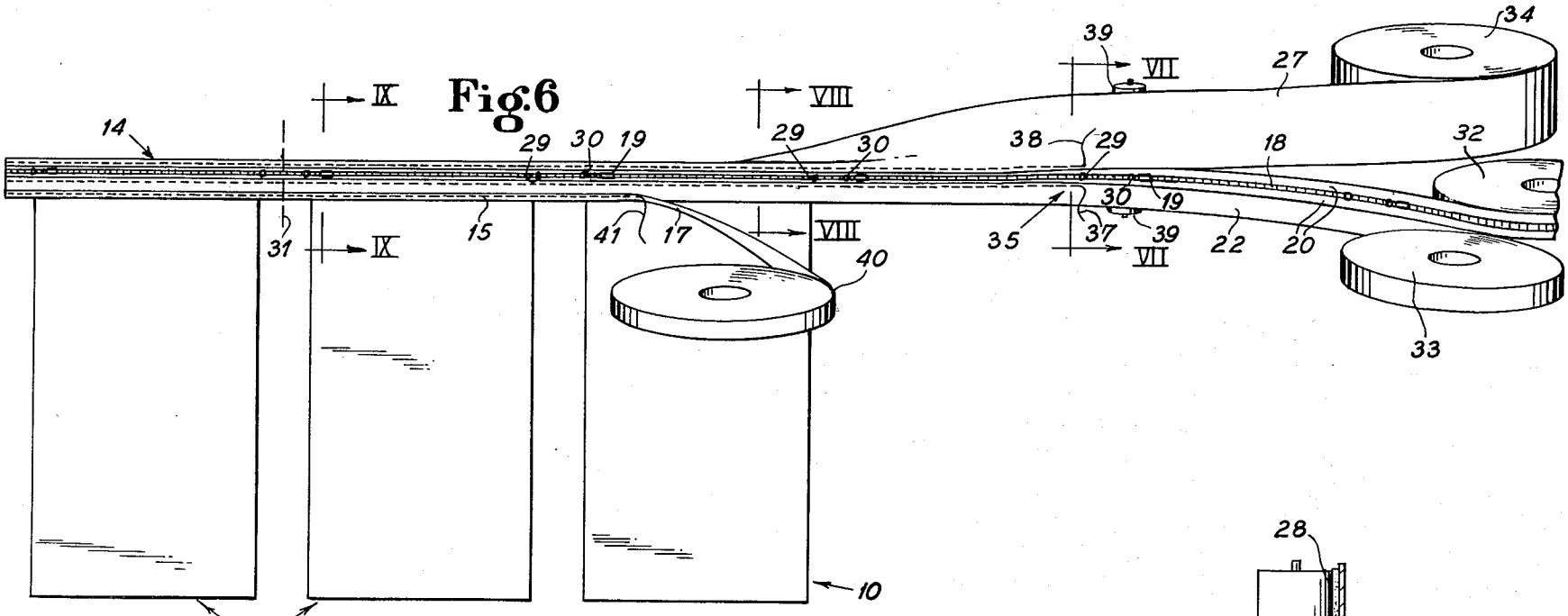
FIG. 6 is a schematic illustration of steps in the method of making the reclosable sacks.
Figure 7:
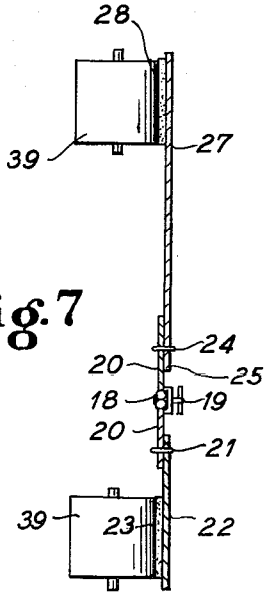
FIG. 7 is a fragmentary sectional detail view taken substantially along the line VII—VII of FIG. 6.
Figure 9:
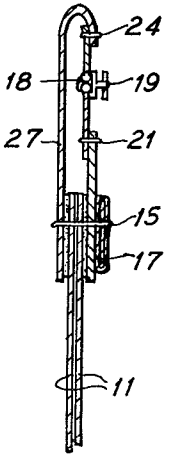
FIG. 9 is a fragmentary sectional detail view taken substantially along the line IX—IX of FIG. 6.
Figure 8:
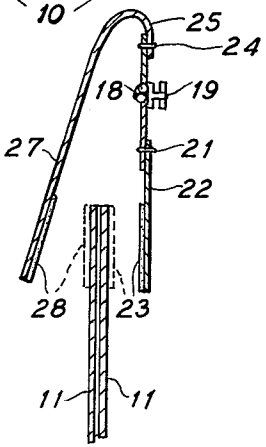
FIG. 8 is a fragmentary sectional view taken substantially along the line VIII—VIII of FIG. 6.

A succession of the tubular collapsed, flattened sack sections is moved along a production line with the sections aligned in parallel suitably spaced relation to one another, substantially as shown in FIG. 6. Top closures 14 are applied to the sack sections as a continuous process, and for this purpose, the several components which are assembled together to produce the top closures are supplied to the top ends of the sack section in uniform coordinated and cotravelling relation employing apparatus suitable for the purpose.

In a desirable arrangement, all of the components for the top closures 14 are supplied as continous tapes, bands or strips, which may be for convenience put up in respective supply rolls or on supply reels. Thus, the zipper 18 may be supplied from a supply roll or reel 32 to join the anchor or attachment strips 22 and 27, the strip 22 being drawn from a supply roll or reel 33 and the strip 27 being drawn from a supply roll or reel 34. The zipper tapes 20 and the strips 22 and 27 are convergently joined in proper relation at a sewing or stitching station 35, where thread or string 37 derive from a suitable source of supply, is stitched to provide the securing stitches 21 by which the strip 22 is attached to one of the zipper tapes 20. Similarly, thread or string 38 derived from a suitable supply source is stitched to provide the securing stitches 25 by which the remaining zipper tape 20 is attached to the attachment strip 27. Either upstream or downstream from the stitching station 35, adhesive 23 may be applied to the inner face of the strip 22 and adhesive 28 may be applied to the inner face of the strip 27 by means of suitable applicators 39 which may be of the nozzle type or roller type or brush type, as may be preferred. Such application of the adhesive may be found advantageous because, at this stage, the zipper tapes 20 and the strips 22 and 27 are desirable in a substantially flat plane. On the other hand, if it is preferred to apply the adhesive to the upper outer margins of the sack walls 11, as indicated in dash outline in FIG. 8, that may be done. The important consideration is that the adhesive 23 and 28 be functional when the strips 22 and 27 are brought into assembly with the sack top. For this purpose, the strip 27 is folded to provide the attachment flange 25 which is secured to the zipper and the remaining body of the strip 27 being folded toward the strip 22, and the strips attached as by means of the adhesive 23 and 28 to the sack walls 11 as by suitable means pressing the same together.

Pressing of the strips 22 and 27 into place on the tops of the sack walls 11 may be effected in advance of or concurrently with application of the primary closure fastener stitching 15 and the rip tape 17. In any event, as a result of the stitching 15 extending through and securing not only the rip tape 17 but also the anchoring or attachment strips 22 and 27 and the top margins of the sack walls 11 tightly together, efficient pressing of the strips 22 and 27 against the sack walls 11 is assured for positive adhesive bonding of the strips 22 and 27 to the sack walls. It will be understood that the material for the rip tape 17 may be supplied from a suitable roll or reel 40 in which the strip is of thrice the width desired in the final strip which is triple-folded longitudinally for greater strength before stitched in place by means of thread or string 41 derived from a suitable source of supply to provide the rip cord fastener 15. At a suitable distance downstream from where the final assembly is effected and the rip cord stitching 15 is applied, the individual sacks 10 are separated from one another by the severance 31 of the fasteners 14 of the individual sacks from one another. The open bottom sacks 10 may be stacked for transportation to filling equipment, or may be directly transported to and filled in filling apparatus, and the bottom closures 13 then fixed on the bags.

It will be understood that variations and modifications may be effected without departing from the spirit and scope of the novel concepts of this invention.

I claim as my invention:

1. A reclosable sack having a mouth from which discrete pourable contents may be poured, comprising:

a primary non-reclosable stitched separable closure fastener across and closing said mouth against unintentional discharge of the contents and including means for facilitating digital opening of the primary closure fastener;

and a secondary, reclosable fastener across said mouth outwardly from said primary closure fastener and adapted for selectively opening and closing said mouth, after opening of said primary closure fastener.

2. A sack according to claim 1, wherein said means for facilitating digital opening of the primary closure fastener comprises a rip tape.

3. A sack according to claim 1, wherein said secondary, reclosable fastener comprises means initially also secured to the sack by means of said stitched separable closure fastener.

4. A sack according to claim 3, wherein said secondary, reclosable fastener comprises strips which are adhesively attached to said sack, and the stitching of said separable closure fastener assures firm adhesive bonding of the strips to the sack.

5. A sack according to claim 1, wherein said secondary, reclosable fastener comprises a zipper, and strips mounting the zipper and attached to opposite walls of the sack.

6. A sack according to claim 5, wherein said zipper comprises zipper tapes, and means securing said zipper tapes to said strips.

7. A sack according to claim 1, wherein said secondary, reclosable fastener comprises a zipper, a slider for opening and closing the zipper, and stops at respectively opposite sides of the bag to prevent escape of the slider from the zipper.

8. A sack according to claim 7, wherein one of said stops extends across the zipper and holds the zipper closed at such stop, and the remaining stop being separable when the zipper is opened.

9. A sack according to claim 8, wherein said secondary fastener extends a limited distance beyond the side of the sack at which said separable stop is located, whereby to function as a pouring spout.

10. A sack according to claim 1, wherein said secondary fastener comprises means extending beyond one side of the sack and adapted to serve as a pouring spout when the secondary fastener is opened.

11. A reclosable sack according to claim 1, wherein said non-reclosable stitched separable closure fastener extends substantially beyond one side of the sack and has chain stitches a plurality of which are on the sideward extension so as to provide assurance against opening of the primary fastener if the initial stitches become loose.

12. A method of making a reclosable sack having a mouth from which discrete pourable contents may be discharged, comprising:

stitching a primary non-reclosable separable closure fastener across, and thereby closing, said mouth against unintentional discharge of the contents, and providing said primary closure fastener with means for facilitating digital opening thereof;

and providing a secondary, reclosable fastener across said mouth outwardly from said primary closure fastener and thereby providing for selectively opening and closing said bag mouth after said primary closure fastener has been opened.

13. A method according to claim 12, comprising stitching a rip tape in place as part of said primary separable closure fastener.

14. A method according to claim 12, which comprises also stitching said secondary fastener by means of the same stitching as said primary fastener.

15. A method according to claim 14, comprising adhesively attaching said reclosable fastener to said sack, said stitching assuring firm adhesive bonding of the reclosable fastener to the sack.

16. A method according to claim 12, wherein said secondary fastener comprises a zipper and strips mounting the zipper, and attaching said strips to opposite walls of the sack.

17. A method according to claim 16, wherein said zipper comprises zipper tapes, and securing said zipper tapes to said strips.

18. A method according to claim 12, wherein said secondary, reclosable fastener comprises a zipper having a slider for opening and closing the zipper, and providing means for stopping movement of the slider at respectively opposite sides of the bag to prevent escape of the slider from the zipper.

19. A method according to claim 12, which comprises applying said fasteners as a continuous strip to a plurality of the sacks disposed in spaced parallel relation, and severing the fastener strip intermediate adjacent sacks and thereby leaving substantial extensions of the fasteners at the sides of the sacks.

20. A method according to claim 12, comprising extending said secondary fastener beyond one side of the sack to serve as a pouring spout when the secondary fastener is opened.

21. A method according to claim 12, which comprises stitching said primary fastener with chain stitches, and extending said primary fastener a substantial distance beyond one side of the sack so as to provide a plurality of the stitches on the extension as assurance against opening of the primary fastener if the initial stitches become loose.

22. A method according to claim 12, which comprises advancing a succession of flattened tubular sack sections in coextensive spaced parallel relation, advancing a continuous strip of zipper having zipper tapes toward meeting with said bag sections, advancing respective attachment strips to meet respective ones of said zipper tapes, securing said zipper tapes to said attachment strips, advancing said zipper strip with the secured attachment strips to meet said sack sections, adhesively securing said attachment strips to respective opposite walls of said sack sections, and stitching said primary fastener in place with respect to one of said attachment strips including extending the stitching through the sack walls and the other of said attachment strips.

* * * * *